US012104811B2

(12) United States Patent
Suzumura

(10) Patent No.: US 12,104,811 B2
(45) Date of Patent: Oct. 1, 2024

(54) AIR CONDITIONER WITH TEMPERATURE PREDICTION CAPABILITY

(71) Applicant: Mitsubishi Electric Corporation, Tokyo (JP)

(72) Inventor: Kazuki Suzumura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 226 days.

(21) Appl. No.: 17/795,738

(22) PCT Filed: Apr. 21, 2020

(86) PCT No.: PCT/JP2020/017250

§ 371 (c)(1),
(2) Date: Jul. 27, 2022

(87) PCT Pub. No.: WO2021/214888

PCT Pub. Date: Oct. 28, 2021

(65) Prior Publication Data

US 2023/0089866 A1 Mar. 23, 2023

(51) Int. Cl.
*F24F 11/46* (2018.01)
*F24F 11/63* (2018.01)
*F24F 110/10* (2018.01)

(52) U.S. Cl.
CPC ..... *F24F 11/46* (2018.01); *F24F 11/63* (2018.01); *F24F 2110/10* (2018.01)

(58) Field of Classification Search
CPC ..... F24F 11/46; F24F 11/63; F24F 2110/10
See application file for complete search history.

(56) References Cited

U.S. PATENT DOCUMENTS

2016/0245539 A1* 8/2016 Motomura ..... F24F 11/84
2017/0167740 A1* 6/2017 Yi ..... F24F 11/80
(Continued)

FOREIGN PATENT DOCUMENTS

JP H11-94327 A 4/1999
JP 2019-184154 A 10/2019

OTHER PUBLICATIONS

International Search Report of the International Searching Authority mailed Jul. 21, 2020 in corresponding International Patent Application No. PCT/JP2020/017250 (with English machine translation).

*Primary Examiner* — Henry T Crenshaw
(74) *Attorney, Agent, or Firm* — Posz Law Group, PLC

(57) ABSTRACT

An air conditioner includes an outdoor unit, a plurality of indoor units, a plurality of detecting units, an operating device that receives an instruction on use of all prediction results obtained for all of a plurality of spaces, a determining circuitry, and a deciding circuitry. The detecting circuitries each detect a state relating to temperature of an associated space. A prediction result obtained for each of the spaces is a predicted temperature of the space associated with one of the detecting circuitries a predetermined time after a detection result is obtained by the one of the detecting circuitries, which is predicted on the basis of the detection result. When all the prediction results are determined not to be the same, the deciding circuitry determines how air conditioning is to be performed on the basis of part or the whole of all the prediction results in accordance with an instruction received by the operating device.

6 Claims, 9 Drawing Sheets

(56) References Cited

U.S. PATENT DOCUMENTS

| | | | | |
|---|---|---|---|---|
| 2017/0198933 | A1* | 7/2017 | Erpelding | G05B 19/0426 |
| 2017/0206615 | A1* | 7/2017 | Sloop | F24F 11/30 |
| 2019/0178525 | A1* | 6/2019 | Urakawa | F24F 3/044 |

* cited by examiner

AIR CONDITIONER WITH TEMPERATURE PREDICTION CAPABILITY

CROSS REFERENCE TO RELATED APPLICATION

This application is a U.S. national stage application of PCT/JP2020/017250 filed on Apr. 21, 2020, the contents of which are incorporated herein by reference.

FIELD

The present disclosure relates to an air conditioner for air conditioning.

BACKGROUND

Air conditioners that obtain information relating to the temperature of a space to be air-conditioned, predict the temperature of the space a predetermined time after the obtainment of the information, and perform air conditioning on the basis of the prediction result have conventionally been known (refer to Patent Literature 1, for example).

CITATION LIST

Patent Literature

Patent Literature 1: Japanese Patent Application Laid-open No. 2019-184154

SUMMARY

Technical Problem

In some cases, one room is divided into a plurality of spaces, an indoor unit is placed in each of the spaces, the indoor units are connected with one outdoor unit, and the outdoor unit and the indoor units perform air conditioning of the room. When all the temperatures predicted for the spaces are not the same, that is, when one of all prediction results is different from the other prediction results, air conditioning cannot be performed on the basis of the prediction results according to the conventional art.

The present disclosure has been made in view of the above, and an object thereof is to provide an air conditioner that performs air conditioning of a room on the basis of temperatures predicted for a plurality of spaces constituting the room even when all the predicted temperatures are not the same.

Solution to Problem

To solve the aforementioned problems and achieve the object, an air conditioner according to the present disclosure includes an outdoor unit, a plurality of indoor units that is connected with the outdoor unit and performs air conditioning with the outdoor unit, a plurality of detecting units that detects a state relating to temperature, an operating device that is operated by a user and receives an instruction on use of a prediction result obtained for each of a plurality of spaces constituting a room, a determining unit that determines whether or not all the prediction results are the same, and a deciding unit that determines a manner how air conditioning is to be performed on the basis of a determination result obtained by the determining unit. The indoor units are each associated with one of the spaces. The detecting units are each associated with one of the spaces. The spaces are each associated with one of the indoor units and are each associated with one of the detecting units. The detecting units each detect a state relating to temperature of an associated space. The prediction result obtained for each of the spaces is a predicted temperature of a space associated with one of the detecting units a predetermined time after the one of the detecting units has obtained a detection result, the temperature being predicted on the basis of the detection result. All the prediction results are prediction results obtained for all the spaces, each of the prediction results being obtained for one of the spaces. When all the prediction results are determined to be the same by the determining unit, the deciding unit determines a manner how air conditioning is to be performed on the basis of any one of all the prediction results. When all the prediction results are determined not to be the same by the determining unit, the deciding unit determines a manner how air conditioning is to be performed on the basis of part or the whole of all the prediction results in accordance with the instruction received by the operating device. The outdoor unit and the indoor units perform air conditioning of the room on the basis of the manner determined by the deciding unit.

Advantageous Effects of Invention

An air conditioner according to the present disclosure produces an effect of enabling air conditioning of a room on the basis of temperatures predicted for a plurality of spaces constituting the room even when all the predicted temperatures are not the same.

DESCRIPTION OF EMBODIMENTS

An air conditioner according to an embodiment will be described in detail below with reference to the drawings.

Embodiment

Figure 1:
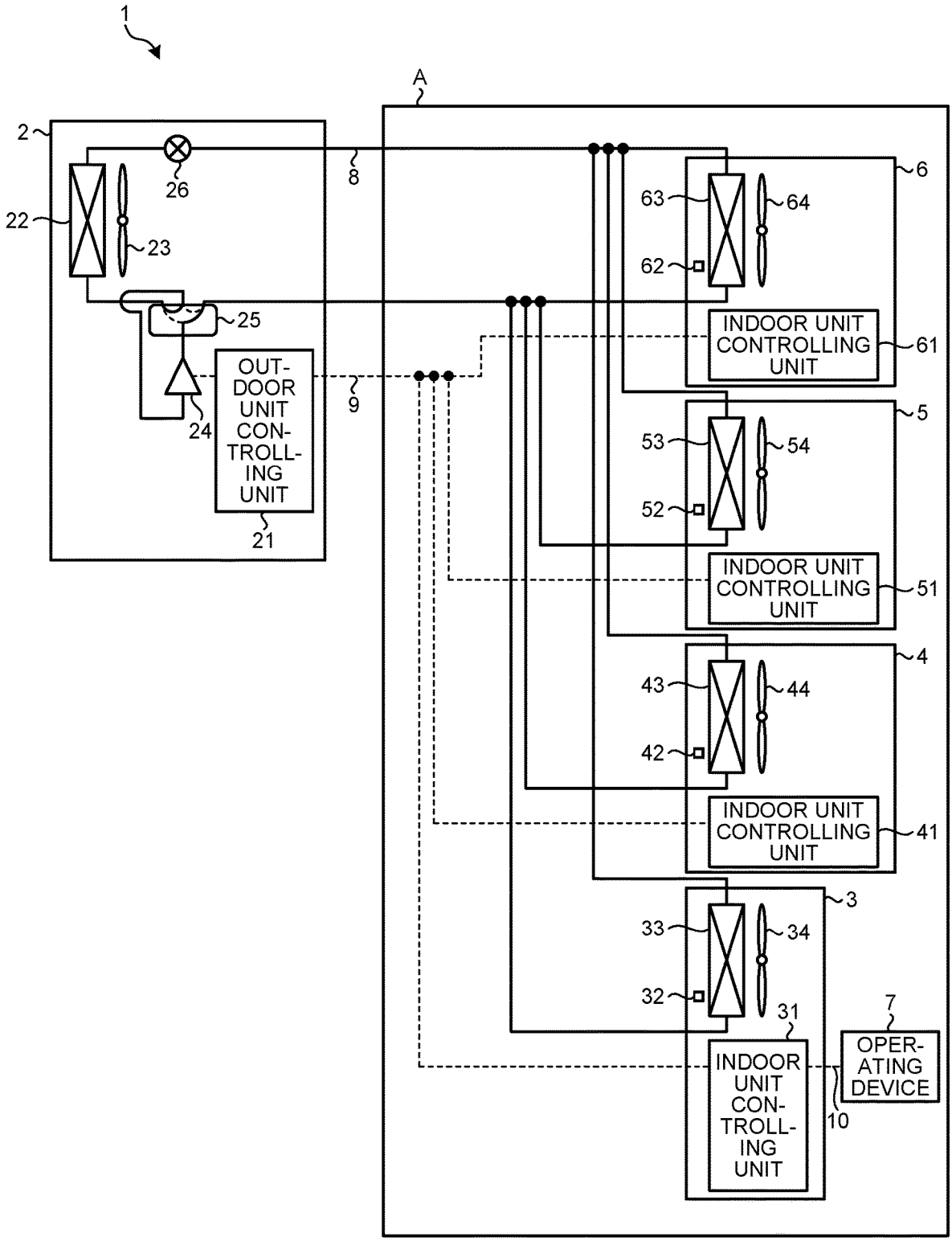
FIG. 1 is a first diagram illustrating a configuration of an air conditioner according to an embodiment.

First, a configuration of an air conditioner 1 according to the embodiment will be described. FIG. 1 is a first diagram illustrating a configuration of the air conditioner 1 according to the embodiment. The air conditioner 1 is a device that performs air conditioning of a room A. An example of the room A is a room of a store or an office. The air conditioner 1 includes an outdoor unit 2 located outside the room A, and a first indoor unit 3, a second indoor unit 4, a third indoor unit 5, and a fourth indoor unit 6 located inside the room A. The first indoor unit 3, the second indoor unit 4, the third indoor unit 5, and the fourth indoor unit 6 are an example of a plurality of indoor units. The first indoor unit 3, the second indoor unit 4, the third indoor unit 5, and the fourth indoor unit 6 are connected with the outdoor unit 2, and perform air conditioning with the outdoor unit 2.

For example, in a case where the room A is divided into four spaces of the same size, the first indoor unit 3 is located in a first space of the four spaces, the second indoor unit 4 is located in a second space of the four spaces, the third indoor unit 5 is located in a third space of the four spaces, and the fourth indoor unit 6 is located in a fourth space of the four spaces. For example, the first indoor unit 3, the second indoor unit 4, the third indoor unit 5, and the fourth indoor unit 6 are installed on the ceiling of the room A. The operation of each of the first indoor unit 3, the second indoor unit 4, the third indoor unit 5, and the fourth indoor unit 6 is the same as those of the other indoor units.

The air conditioner 1 further includes an operating device 7 to be operated by a user. The operating device 7 is located inside the room A. The operating device 7 is a remote controller for controlling the operations of the outdoor unit 2, the first indoor unit 3, the second indoor unit 4, the third indoor unit 5, and the fourth indoor unit 6.

The air conditioner 1 further includes refrigerant piping 8 through which refrigerant flows. The refrigerant piping 8 connects the outdoor unit 2 with each of the first indoor unit 3, the second indoor unit 4, the third indoor unit 5, and the fourth indoor unit 6. The air conditioner 1 further includes a first communication line 9 and a second communication line 10 for performing communication. The first communication line 9 connects the outdoor unit 2 with each of the first indoor unit 3, the second indoor unit 4, the third indoor unit 5, and the fourth indoor unit 6, and is used for communication between the outdoor unit 2 and each of the first indoor unit 3, the second indoor unit 4, the third indoor unit 5, and the fourth indoor unit 6. The first communication line 9 is also used for communication between the first indoor unit 3 and each of the second indoor unit 4, the third indoor unit 5, and the fourth indoor unit 6. The second communication line 10 connects the first indoor unit 3 with the operating device 7, and is used for communication between the first indoor unit 3 and the operating device 7.

The outdoor unit 2 includes an outdoor unit controlling unit 21 that performs control on air conditioning. The outdoor unit controlling unit 21 communicates with each of the first indoor unit 3, the second indoor unit 4, the third indoor unit 5, and the fourth indoor unit 6 via the first communication line 9. The outdoor unit controlling unit 21 identifies with which of the first indoor unit 3, the second indoor unit 4, the third indoor unit 5, and the fourth indoor unit 6 the outdoor unit controlling unit 21 is communicating.

The outdoor unit controlling unit 21 further includes an outdoor unit heat exchanger 22 for heat exchange between refrigerant and air, an outdoor unit fan 23 for moving the air, and a compressor 24 for compressing the refrigerant. The compressor 24 includes an inverter, which is not illustrated. The outdoor unit controlling unit 21 further includes a four-way valve 25 for switching between refrigerant passages, and an expansion valve 26 for expanding the refrigerant.

The first indoor unit 3 includes an indoor unit controlling unit 31 that performs control on air conditioning. The indoor unit controlling unit 31 is connected with the operating device 7 by the second communication line 10. The first indoor unit 3 further includes a detecting unit 32 that detects a state relating to the temperature of a space associated with the first indoor unit 3. An example of the associated space will be described later with reference to FIG. 2. An example of a state relating to the temperature of the associated space is some or all of the temperature of the associated space, the influence of insolation on the associated space, and the presence of a heat source in the associated space. For example, part of the detecting unit 32 is a thermistor. The first indoor unit 3 further includes an indoor unit heat exchanger 33 for heat exchange between refrigerant and air, and an indoor unit fan 34 for moving the air.

The second indoor unit 4 includes an indoor unit controlling unit 41, a detecting unit 42, an indoor unit heat exchanger 43, and an indoor unit fan 44. The third indoor unit 5 includes an indoor unit controlling unit 51, a detecting unit 52, an indoor unit heat exchanger 53, and an indoor unit fan 54. The fourth indoor unit 6 includes an indoor unit controlling unit 61, a detecting unit 62, an indoor unit heat exchanger 63, and an indoor unit fan 64. The indoor unit controlling unit 41, the indoor unit controlling unit 51, and the indoor unit controlling unit 61 each have the same functions as those of the indoor unit controlling unit 31.

The detecting unit 32, the detecting unit 42, the detecting unit 52, and the detecting unit 62 are an example of a plurality of detecting units. The detecting unit 42, the detecting unit 52, and the detecting unit 62 each have the same functions as those of the detecting unit 32. Specifically, the detecting unit 42 detects a state relating to the temperature of a space associated with the second indoor unit 4, the detecting unit 52 detects a state relating to the temperature of a space associated with the third indoor unit 5, and the detecting unit 62 detects a state relating to the temperature of a space associated with the fourth indoor unit 6. The indoor unit heat exchanger 43, the indoor unit heat exchanger 53, and the indoor unit heat exchanger 63 each have the same functions as those of the indoor unit heat exchanger 33. The indoor unit fan 44, the indoor unit fan 54, and the indoor unit fan 64 each have the same functions as those of the indoor unit fan 34.

Note that the first indoor unit 3 may not include the detecting unit 32. In this case as well, the air conditioner 1 includes a detecting unit 32, which detects a state relating to the temperature of the space associated with the first indoor unit 3. The second indoor unit 4 may not include the detecting unit 42. In this case as well, the air conditioner 1 includes a detecting unit 42, which detects a state relating to the temperature of the space associated with the second indoor unit 4. The third indoor unit 5 may not include the detecting unit 52. In this case as well, the air conditioner 1 includes a detecting unit 52, which detects a state relating to the temperature of the space associated with the third indoor unit 5. The fourth indoor unit 6 may not include the detecting unit 62. In this case as well, the air conditioner 1 includes a detecting unit 62, which detects a state relating to the temperature of the space associated with the fourth indoor unit 6.

The operating device 7 is connected only with the first indoor unit 3 among the first indoor unit 3, the second indoor unit 4, the third indoor unit 5, and the fourth indoor unit 6, and transmits operation information, which is information corresponding to operations performed on the operating device 7 by a user, to the first indoor unit 3 via the second communication line 10. The operation information includes instructions from the user. The indoor unit controlling unit 31 of the first indoor unit 3 receives the operation information transmitted from the operating device 7, and transmits the operation information to the outdoor unit controlling unit 21 of the outdoor unit 2 via the first communication line 9.

The outdoor unit controlling unit 21 receives the operation information transmitted from the indoor unit controlling unit 31, and transmits the operation information to the indoor unit controlling unit 41 of the second indoor unit 4, the indoor unit controlling unit 51 of the third indoor unit 5, and the indoor unit controlling unit 61 of the fourth indoor unit 6 via the first communication line 9. In this manner, the operation information is shared by the entire air conditioner 1. As a result, the outdoor unit 2, the first indoor unit 3, the second indoor unit 4, the third indoor unit 5, and the fourth indoor unit 6 can perform one operation corresponding to the operation information. Examples of the operation include starting operation and stopping operation on the air conditioning. Examples of the operation on the air conditioning include heating operation and cooling operation.

In practice, the operations of the outdoor unit 2, the first indoor unit 3, the second indoor unit 4, the third indoor unit 5, and the fourth indoor unit 6 are not determined only by the operation information. For example, in a case where the operation information includes an instruction to perform cooling operation and a set temperature, the outdoor unit controlling unit 21 causes the compressor 24 to operate when the temperature of the space associated with the first indoor unit 3 detected by the detecting unit 32 is higher than the set temperature, and the outdoor unit controlling unit 21 does not cause the compressor 24 to operate when the temperature detected by the detecting unit 32 is equal to or lower than the set temperature.

The operating device 7 has a function of displaying information. For example, the operating device 7 includes a touch panel, on which information is displayed. For example, the indoor unit controlling unit 31 transmits information indicating a current operation status to the operating device 7 via the second communication line 10, and the operating device 7 receives the information transmitted from the indoor unit controlling unit 31 and display the information indicating the current operation status.

Figure 2:
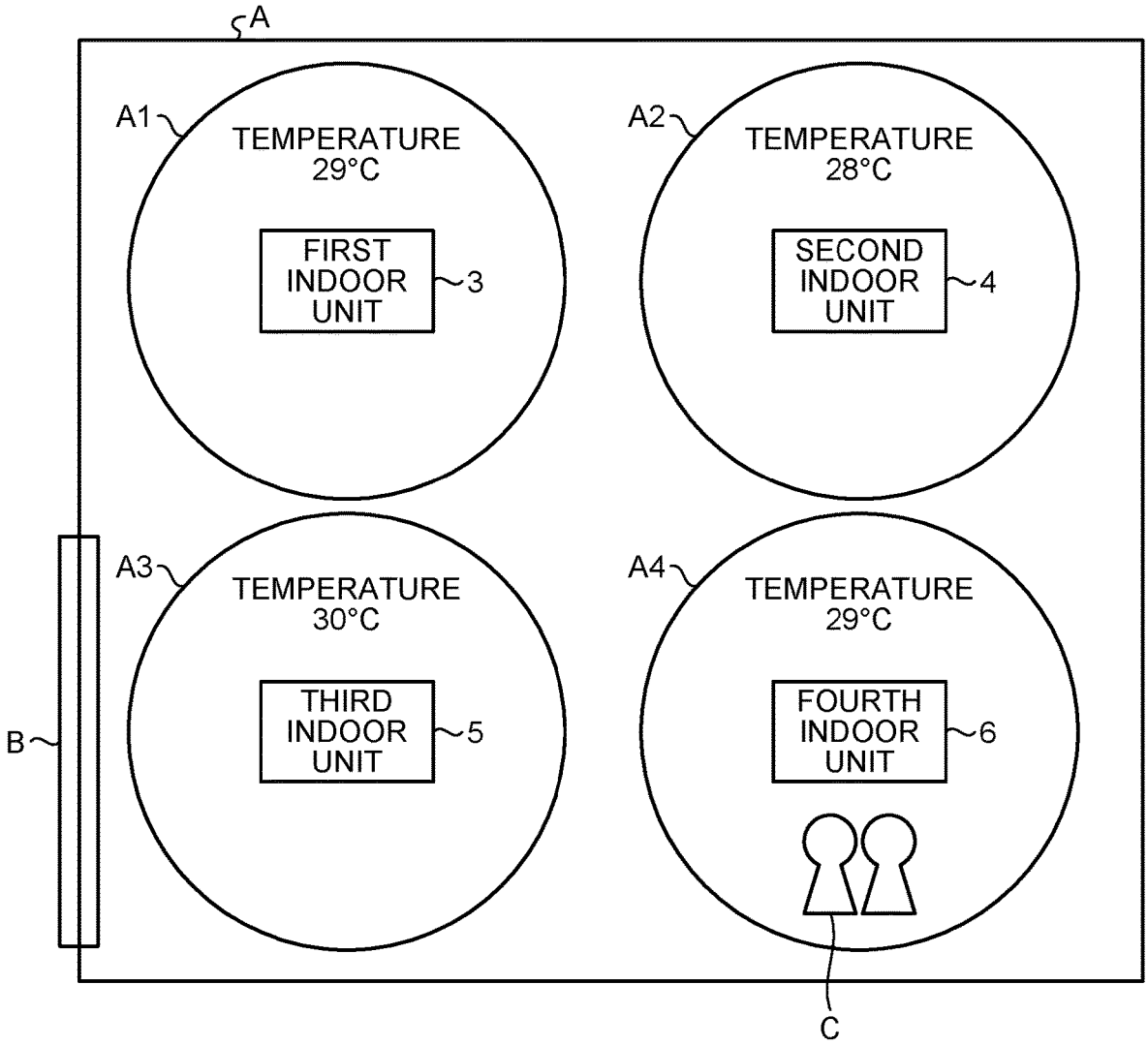
FIG. 2 is a diagram illustrating an example of a state in which a first indoor unit, a second indoor unit, a third indoor unit, and a fourth indoor unit included in the air conditioner according to the embodiment are arranged in a room.

FIG. 2 is a diagram illustrating an example of a state in which the first indoor unit 3, the second indoor unit 4, the third indoor unit 5, and the fourth indoor unit 6 included in the air conditioner 1 according to the embodiment are arranged in the room A. Specifically, FIG. 2 illustrates a plane in a case where the first indoor unit 3, the second indoor unit 4, the third indoor unit 5, and the fourth indoor unit 6 are arranged in the room A. FIG. 2 illustrates a space A1 in which the first indoor unit 3 is arranged, a space A2 in which the second indoor unit 4 is arranged, a space A3 in which the third indoor unit 5 is arranged, and a space A4 in which the fourth indoor unit 6 is arranged.

Any one of the four spaces of the space A1, the space A2, the space A3, and the space A4 has a size equal to that of another of the four spaces. The first indoor unit 3 is associated with the space A1, the second indoor unit 4 is associated with the space A2, the third indoor unit 5 is associated with the space A3, and the fourth indoor unit 6 is associated with the space A4. The space A1 is associated with the first indoor unit 3, the space A2 is associated with the second indoor unit 4, the space A3 is associated with the third indoor unit 5, and the space A4 is associated with the fourth indoor unit 6.

Furthermore, the detecting unit 32 is associated with the space A1, the detecting unit 42 is associated with the space A2, the detecting unit 52 is associated with the space A3, and the detecting unit 62 is associated with the space A4. The space A1 is associated with the detecting unit 32, the space A2 is associated with the detecting unit 42, the space A3 is associated with the detecting unit 52, and the space A4 is associated with the detecting unit 62.

The room A has a window B. The space A3 is a space that is closest to the window B of the four spaces. Because the window B is heated by insolation, the temperature of the space A3 is likely to be higher than the temperatures of the space A1, the space A2, and the space A4. People are present in the space A4. A person corresponds to a heat source C. The detecting unit 32 detects the temperature of the space A1, the influence of insolation on the space A1, and the presence of a heat source in the space A1. In a manner similar to the detecting unit 32, each of the detecting unit 42, the detecting unit 52, and the detecting unit 62 detects the temperature of the associated space, the influence of insolation on the associated space, and the presence of a heat source in the associated space. FIG. 2 indicates that the temperature of the space A1 is 29° C., the temperature of the space A2 is 28° C., the temperature of the space A3 is 30° C., and the temperature of the space A4 is 29° C.

Figure 3:
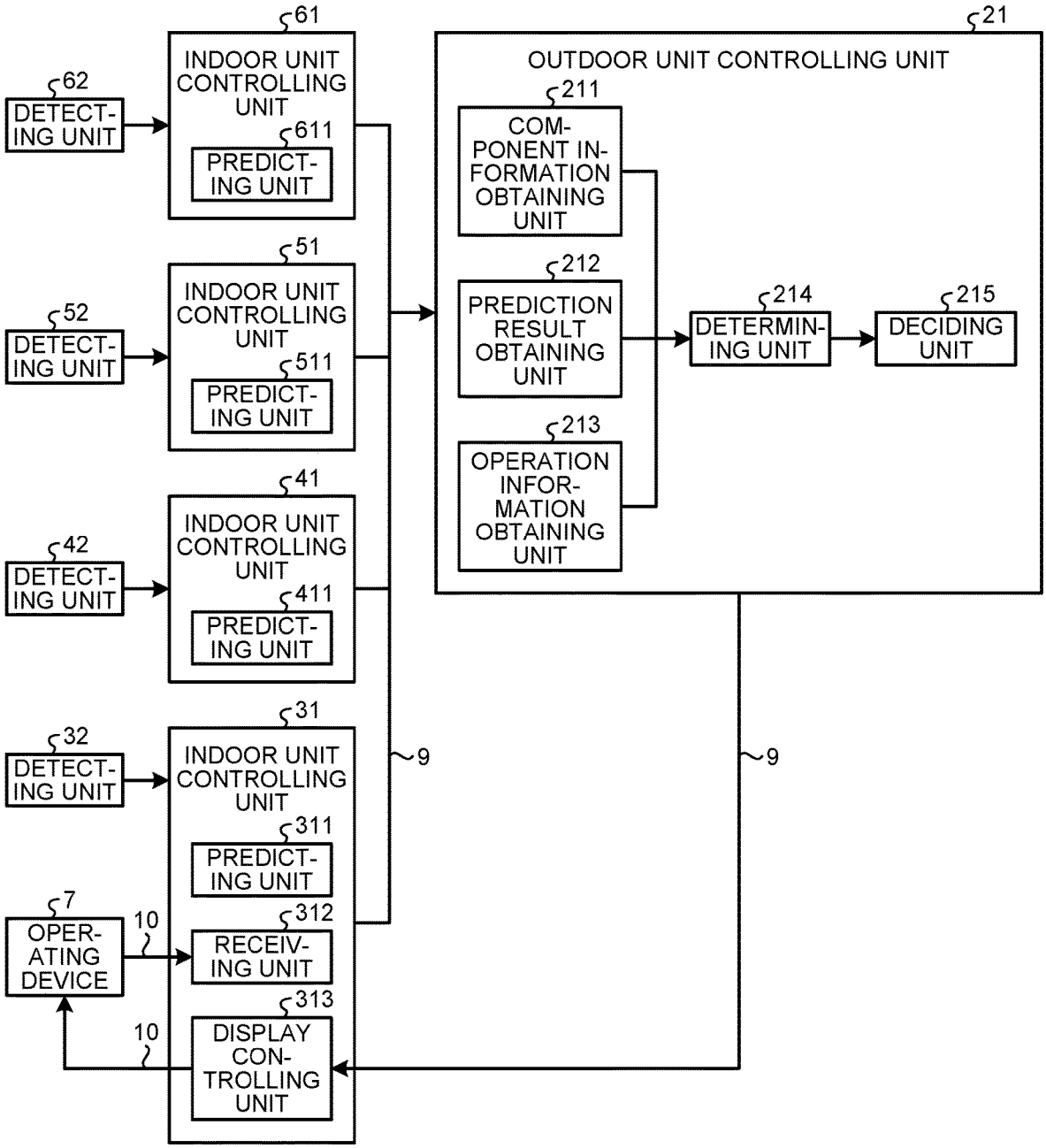
FIG. 3 is a second diagram illustrating the configuration of the air conditioner according to the embodiment.

FIG. 3 is a second diagram illustrating the configuration of the air conditioner 1 according to the embodiment. As described above, the air conditioner 1 includes the outdoor unit 2, the first indoor unit 3, the second indoor unit 4, the third indoor unit 5, the fourth indoor unit 6, and the operating device 7. The first indoor unit 3 includes the indoor unit controlling unit 31 and the detecting unit 32. The indoor unit controlling unit 31 includes a predicting unit 311 that predicts the temperature of the space A1 a predetermined time after a detection result is obtained by the detecting unit 32 on the basis of the detection result to obtain a prediction result. The space A1 is a space associated with the first indoor unit 3.

The indoor unit controlling unit 31 further includes a receiving unit 312 that receives the operation information transmitted from the operating device 7. As described above, the operation information includes instructions from the user. The indoor unit controlling unit 31 further includes a display controlling unit 313 that generates information to be displayed on the operating device 7, and transmits the information to the operating device 7. For example, the information is generated on the basis of operation states of the outdoor unit controlling unit 21, the indoor unit controlling unit 31, the indoor unit controlling unit 41, the indoor unit controlling unit 51, and the indoor unit controlling unit 61.

The indoor unit controlling unit 41 of the second indoor unit 4 includes a predicting unit 411 that predicts the temperature of the space A2 a predetermined time after a detection result is obtained by the detecting unit 42 on the basis of the detection result to obtain a prediction result. The space A2 is a space associated with the second indoor unit 4. The indoor unit controlling unit 51 of the third indoor unit 5 includes a predicting unit 511 that predicts the temperature of the space A3 a predetermined time after a detection result is obtained by the detecting unit 52 on the basis of the detection result to obtain a prediction result. The space A3 is a space associated with the third indoor unit 5. The indoor unit controlling unit 61 of the fourth indoor unit 6 includes a predicting unit 611 that predicts the temperature of the space A4 a predetermined time after a detection result is obtained by the detecting unit 62 on the basis of the detection result to obtain a prediction result. The space A4 is a space associated with the fourth indoor unit 6.

The first indoor unit 3 transmits the prediction result obtained by the predicting unit 311 to the outdoor unit 2 and the operating device 7. The second indoor unit 4 transmits the prediction result obtained by the predicting unit 411 to the outdoor unit 2 and the first indoor unit 3. The third indoor unit 5 transmits the prediction result obtained by the predicting unit 511 to the outdoor unit 2 and the first indoor unit 3. The fourth indoor unit 6 transmits the prediction result obtained by the predicting unit 611 to the outdoor unit 2 and the first indoor unit 3. The first indoor unit 3 receives the prediction results transmitted from the second indoor unit 4, the third indoor unit 5, and the fourth indoor unit 6, and transmits the received prediction results to the operating device 7. Thus, all the prediction results obtained by the second indoor unit 4, the third indoor unit 5, and the fourth indoor unit 6 are transmitted to the outdoor unit 2 and the operating device 7.

The operating device 7 receives instructions on the use of all the prediction results obtained by the first indoor unit 3, the second indoor unit 4, the third indoor unit 5, and the fourth indoor unit 6 provided by operations performed by the user. In other words, the operating device 7 receives an instruction on the use of the prediction result obtained for each of the spaces constituting the room A. The prediction result obtained for each of the spaces is a predicted temperature of the space associated with one of the detecting unit 32, the detecting unit 42, the detecting unit 52, and the detecting unit 62 a predetermined time after a detection result is obtained by the one detecting unit, which is predicted on the basis of the detection result.

All the prediction results are prediction results obtained for all the spaces, each of the prediction results being obtained for one of the spaces. Specific examples of the instructions on the use of all the prediction results received by the operating device 7 will be described later. The receiving unit 312 of the indoor unit controlling unit 31 receives the operation information received by the operating device 7 and transmitted from the operating device 7, and transmits the operation information to the outdoor unit controlling unit 21. The operation information includes instructions on the use of all the prediction results.

The outdoor unit controlling unit 21 includes a component information obtaining unit 211 that obtains information indicating the number of indoor units connected with the outdoor unit 2. Specifically, the component information obtaining unit 211 obtains the number of indoor units connected with the outdoor unit 2 through communication via the first communication line 9. The outdoor unit controlling unit 21 further includes a prediction result obtaining unit 212 that obtains all the prediction results obtained by the predicting unit 311, the predicting unit 411, the predicting unit 511, and the predicting unit 611. Thus, the prediction result obtaining unit 212 obtains all the prediction results obtained by the first indoor unit 3, the second indoor unit 4, the third indoor unit 5, and the fourth indoor unit 6.

The outdoor unit controlling unit 21 further includes an operation information obtaining unit 213 that obtains the operation information transmitted from the receiving unit 312. The operation information includes the instructions on the use of all the prediction results obtained by the first indoor unit 3, the second indoor unit 4, the third indoor unit 5, and the fourth indoor unit 6. The outdoor unit controlling unit 21 further includes a determining unit 214 that determines whether or not all the prediction results obtained by the first indoor unit 3, the second indoor unit 4, the third indoor unit 5, and the fourth indoor unit 6 are the same.

The outdoor unit controlling unit 21 further includes a deciding unit 215 that determines a manner how air conditioning is to be performed on the basis of a determination result obtained by the determining unit 214. When all the prediction results obtained by the first indoor unit 3, the second indoor unit 4, the third indoor unit 5, and the fourth indoor unit 6 are determined to be the same by the determining unit 214, the deciding unit 215 determines how air conditioning is to be performed on the basis of any one of all the prediction results.

When all the prediction results are determined not to be the same by the determining unit 214, the deciding unit 215 determines how air conditioning is to be performed on the basis of part or the whole of all the prediction results in accordance with an instruction received by the operating device 7. The instruction received by the operating device 7 is an instruction on the use of all the prediction results. For example, when all the prediction results are determined not to be the same by the determining unit 214, the deciding unit 215 selects any one of all the prediction results and determines how air conditioning is to be performed on the basis of the selected prediction result in accordance with an instruction received by the operating device 7.

The outdoor unit 2, the first indoor unit 3, the second indoor unit 4, the third indoor unit 5, and the fourth indoor unit 6 perform air conditioning of the room A in a manner determined by the deciding unit 215. For example, the outdoor unit 2, the first indoor unit 3, the second indoor unit 4, the third indoor unit 5, and the fourth indoor unit 6 perform air conditioning to bring the temperature the whole room A closer to the set temperature in a manner determined by the deciding unit 215.

When all the prediction results are not the same, that is, when one of all the prediction results is different from the others, the operating device 7 receives instructions on the use of all the prediction results in air conditioning. For example, the operating device 7 receives an instruction to achieve predetermined comfort, an instruction to minimize energy consumption, and an instruction to specify an indoor unit that obtains a prediction result to be used in air conditioning among the first indoor unit 3, the second indoor unit 4, the third indoor unit 5, and the fourth indoor unit 6. The operating device 7 may receive an instruction on the use of all the prediction results before a determination result is obtained by the determining unit 214 or after a determination result is obtained by the determining unit 214. Thus, the operating device 7 may receive an instruction to specify a prediction result to be used in air conditioning after it is determined by the determining unit 214 that all the prediction results are not the same.

Figure 4:
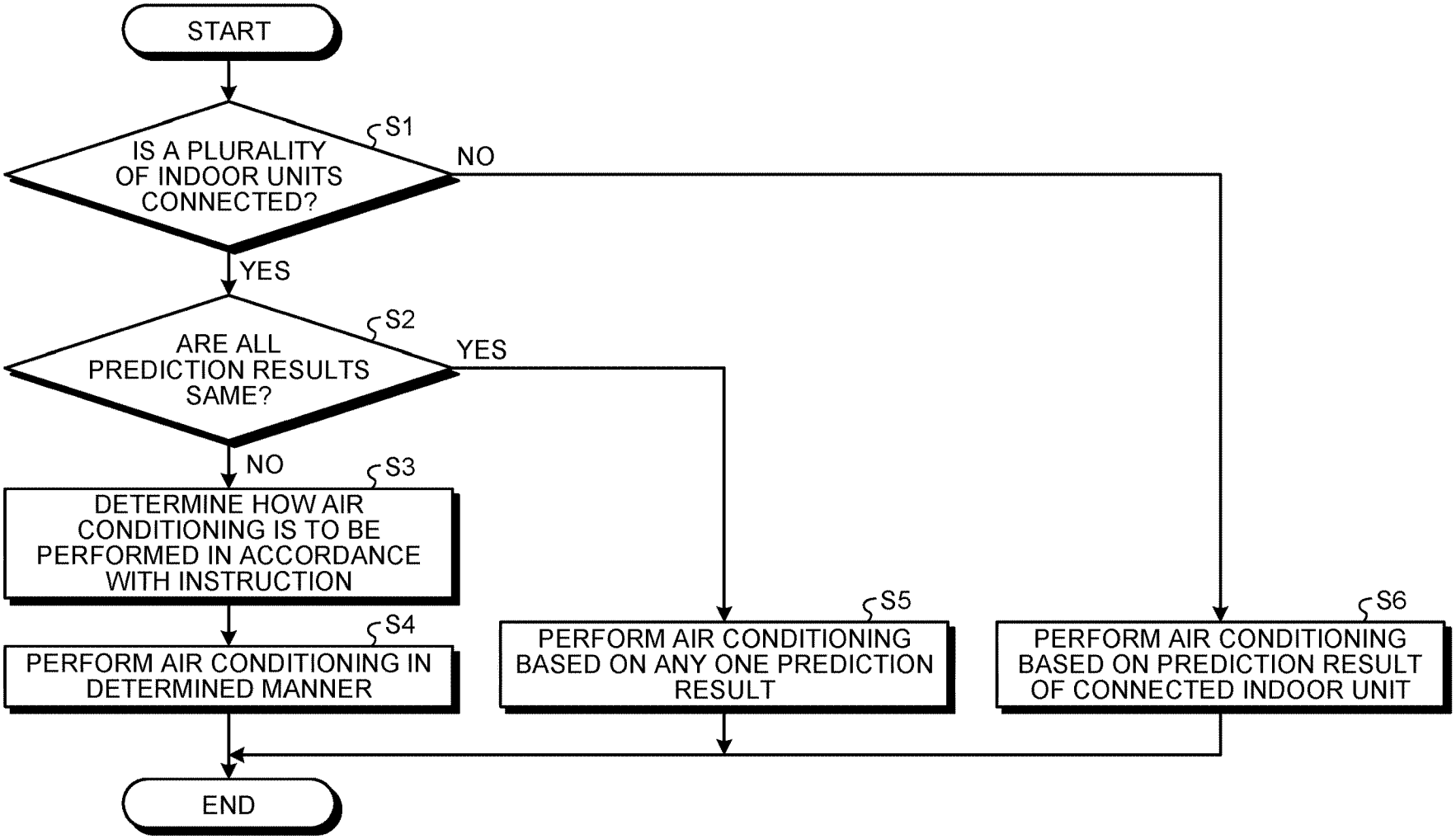
FIG. 4 is a first flowchart illustrating procedures of part of operations performed by the air conditioner according to the embodiment.

Next, the operation of the air conditioner 1 according to the embodiment will be explained. FIG. 4 is a first flowchart illustrating procedures of part of operations performed by the air conditioner 1 according to the embodiment. Hereinafter, assume that the component information obtaining unit 211 has obtained information indicating the number of indoor units connected with the outdoor unit 2, and that the prediction result obtaining unit 212 has obtained all the prediction results obtained by the first indoor unit 3, the second indoor unit 4, the third indoor unit 5, and the fourth indoor unit 6. In addition, assume that the operation information obtaining unit 213 has obtained an instruction on the use of all the prediction results.

The determining unit 214 determines whether or not a plurality of indoor units is connected with the outdoor unit 2 (S1). If the determining unit 214 has determined that a plurality of indoor units is connected with the outdoor unit 2 (Yes in S1), the determining unit 214 determines whether or not all the prediction results are the same (S2). If all the prediction results are determined not to be the same by the determining unit 214 (No in S2), the deciding unit 215 determines how air conditioning is to be performed in accordance with the instruction received by the operating device 7 (S3). This instruction is an instruction on the use of all the prediction results. The outdoor unit 2, the first indoor unit 3, the second indoor unit 4, the third indoor unit 5, and the fourth indoor unit 6 perform air conditioning in the manner determined by the deciding unit 215 (S4). Details of the operations in steps S3 and S4 will be described later with reference to FIG. 8.

If all the prediction results are determined to be the same by the determining unit 214 (Yes in S2), the deciding unit 215 determines how air conditioning is to be performed on the basis of any one of all the prediction results, and the outdoor unit 2, the first indoor unit 3, the second indoor unit 4, the third indoor unit 5, and the fourth indoor unit 6 perform air conditioning on the basis of the one prediction result (S5). If it is determined by the determining unit 214 that only one indoor unit is connected with the outdoor unit 2 (No in S1), the outdoor unit 2 and the indoor unit connected with the outdoor unit 2 perform air conditioning on the basis of a prediction result obtained by the indoor unit connected with the outdoor unit 2 (S6).

Next, details of examples of the operations in steps S3 and S4 in FIG. 4 will be explained. If all the prediction results obtained by the first indoor unit 3, the second indoor unit 4, the third indoor unit 5, and the fourth indoor unit 6 are determined not to be the same by the determining unit 214, the first indoor unit 3 receives the determination result obtained by the determining unit 214 from the outdoor unit 2, and transmits the determination result to the operating device 7. The operating device 7 receives the determination result transmitted from the first indoor unit 3, and displays the determination result. The user sets, on the operating device 7, an instruction on the use of all the prediction results when all the prediction results are not the same. The operating device 7 receives the instruction, and transmits the instruction to the first indoor unit 3.

Specifically, when all the prediction results are not the same, the user sets, on the operating device 7, a particular indoor unit that has obtained a prediction result to be used among the first indoor unit 3, the second indoor unit 4, the third indoor unit 5, and the fourth indoor unit 6. Alternatively, when all the prediction results are not the same, the user sets a specific use of all the prediction results other than that of the particular indoor unit. Thus, the instruction on the use of all the prediction results is an instruction to specify an indoor unit that has obtained a prediction result to be used from among the first indoor unit 3, the second indoor unit 4, the third indoor unit 5, and the fourth indoor unit 6 or an instruction to specify a specific use of all the prediction results other than that of the particular indoor unit.

Figure 5:
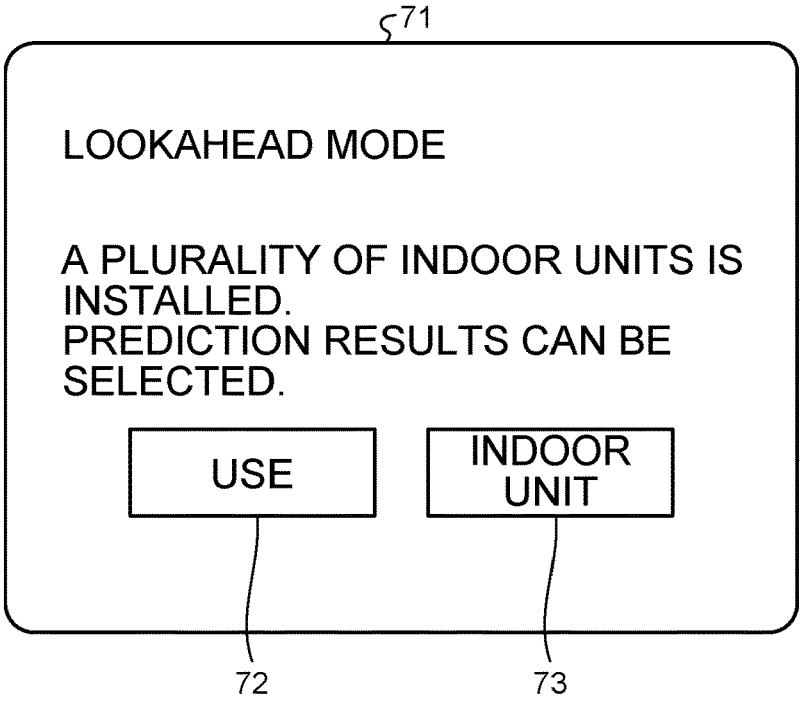
FIG. 5 is a diagram illustrating an example of a first image displayed by an operating device of the air conditioner according to the embodiment.

FIG. 5 is a diagram illustrating an example of a first image 71 displayed by the operating device 7 of the air conditioner 1 according to the embodiment. FIG. 5 is a first diagram for explaining a method by which a user sets, on the operating device 7, an instruction on the use of all the prediction results. The first image 71 is displayed when all the prediction results are determined not to be the same by the determining unit 214. Hereinafter, assume that the operating device 7 includes a touch panel, and the first image 71 is displayed on the touch panel.

A text "LOOKAHEAD MODE" in the first image 71 indicates that air conditioning is performed on the basis of some or all of the prediction results. The first image 71 includes a text "A PLURALITY OF INDOOR UNITS IS INSTALLED." indicating that a plurality of indoor units is connected with the outdoor unit 2, and a text "PREDICTION RESULTS CAN BE SELECTED." prompting the user to set an instruction on the use of all the prediction results.

The first image 71 includes a button 72 with a text "USE" for setting a specific use of all the prediction results other than that of the particular indoor unit, and a button 73 with a text "INDOOR UNIT" for specifying an indoor unit that has obtained a prediction result to be used. The user presses the button 72 for setting a specific use of all the prediction results other than that of the particular indoor unit, and presses the button 73 for setting a particular indoor unit that has obtained a prediction result to be used.

Figure 6:
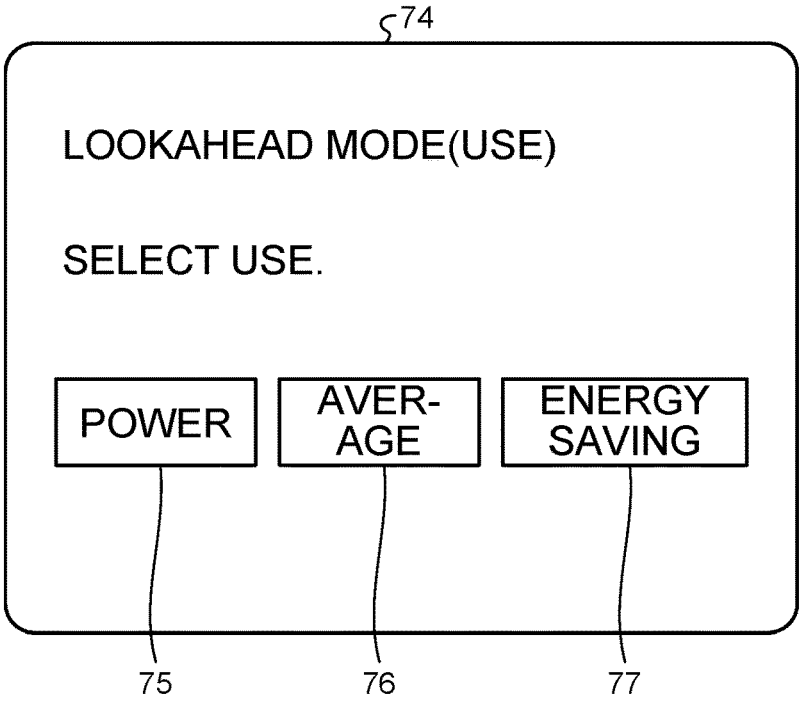
FIG. 6 is a diagram illustrating an example of a second image displayed by the operating device of the air conditioner according to the embodiment.

FIG. 6 is a diagram illustrating an example of a second image 74 displayed by the operating device 7 of the air conditioner 1 according to the embodiment. FIG. 6 is a second diagram for explaining a method by which a user sets, on the operating device 7, an instruction on the use of all the prediction results. The second image 74 is displayed when the button 72 is pressed on the first image 71. A text "LOOKAHEAD MODE (USE)" in the second image 74 indicates that the user has set, on the operating device 7, a specific use of all the prediction results other than that of a particular indoor unit.

The second image 74 includes a text "SELECT USE." for prompting the user to set a specific use of all the prediction results other than that of a particular indoor unit. The second image 74 includes a button 75 of "POWER" for specifying the use of all the prediction results when the air conditioner 1 performs air conditioning at maximum power, a button 76 of "AVERAGE" for specifying the use of all the prediction results when the air conditioner 1 performs air conditioning using an average of all the prediction results, and a button 77 of "POWER SAVING" for specifying the use of all the prediction results when the air conditioner 1 performs air conditioning at minimum energy consumption.

The user presses the button 75 for causing the air conditioner 1 to perform air conditioning at maximum power, presses the button 76 for causing the air conditioner 1 to perform air conditioning by using an average of all the prediction results, and presses the button 77 for causing the air conditioner 1 to perform air conditioning at minimum energy consumption.

Figure 7:
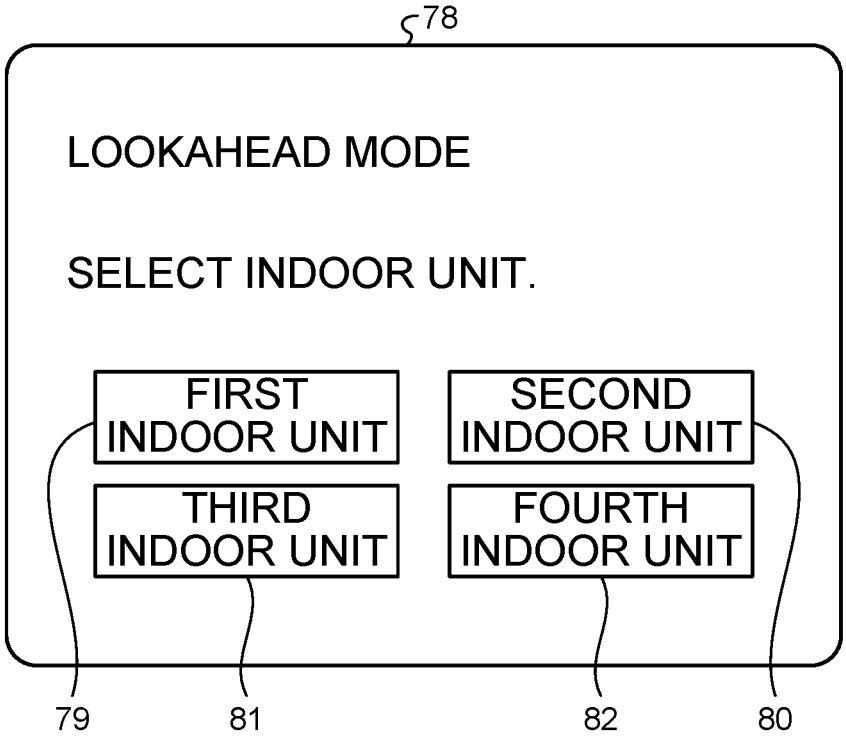
FIG. 7 is a diagram illustrating an example of a third image displayed by the operating device of the air conditioner according to the embodiment.

FIG. 7 is a diagram illustrating an example of a third image 78 displayed by the operating device 7 of the air conditioner 1 according to the embodiment. FIG. 7 is a third diagram for explaining a method by which a user sets, on the operating device 7, an instruction on the use of all the prediction results. The third image 78 is displayed when the button 73 is pressed on the first image 71. A text "LOOKAHEAD MODE" in the third image 78 indicates that air conditioning is performed on the basis of some or all of the prediction results. The third image 78 includes a text "SELECT INDOOR UNIT." for prompting the user to set a particular indoor unit that has obtained a prediction result to be used from among the first indoor unit 3, the second indoor unit 4, the third indoor unit 5, and the fourth indoor unit 6.

The third image 78 may display additional information indicating criteria on the basis of which the user selects any of the first indoor unit 3, the second indoor unit 4, the third indoor unit 5, and the fourth indoor unit 6. For example, the additional information includes some or all of prediction results of individual indoor units, the temperatures of the spaces in which individual indoor units are located, and the heat characteristics of the spaces in which individual indoor units are located. The additional information may be displayed in a form of texts or symbols, or a plurality of buttons with different color densities. The operating device 7 may have a function of switching display of the additional information.

The third image 78 includes a button 79 associated with the first indoor unit 3, a button 80 associated with the second indoor unit 4, a button 81 associated with the third indoor unit 5, and a button 82 associated with the fourth indoor unit 6. The user presses the button 79 for causing the air conditioner 1 to perform air conditioning on the basis of the prediction result obtained by the first indoor unit 3, presses the button 80 for causing the air conditioner 1 to perform air conditioning on the basis of the prediction result obtained by the second indoor unit 4, presses the button 81 for causing the air conditioner 1 to perform air conditioning on the basis of the prediction result obtained by the third indoor unit 5, and presses the button 82 for causing the air conditioner 1 to perform air conditioning on the basis of the prediction result obtained by the fourth indoor unit 6.

Figure 8:
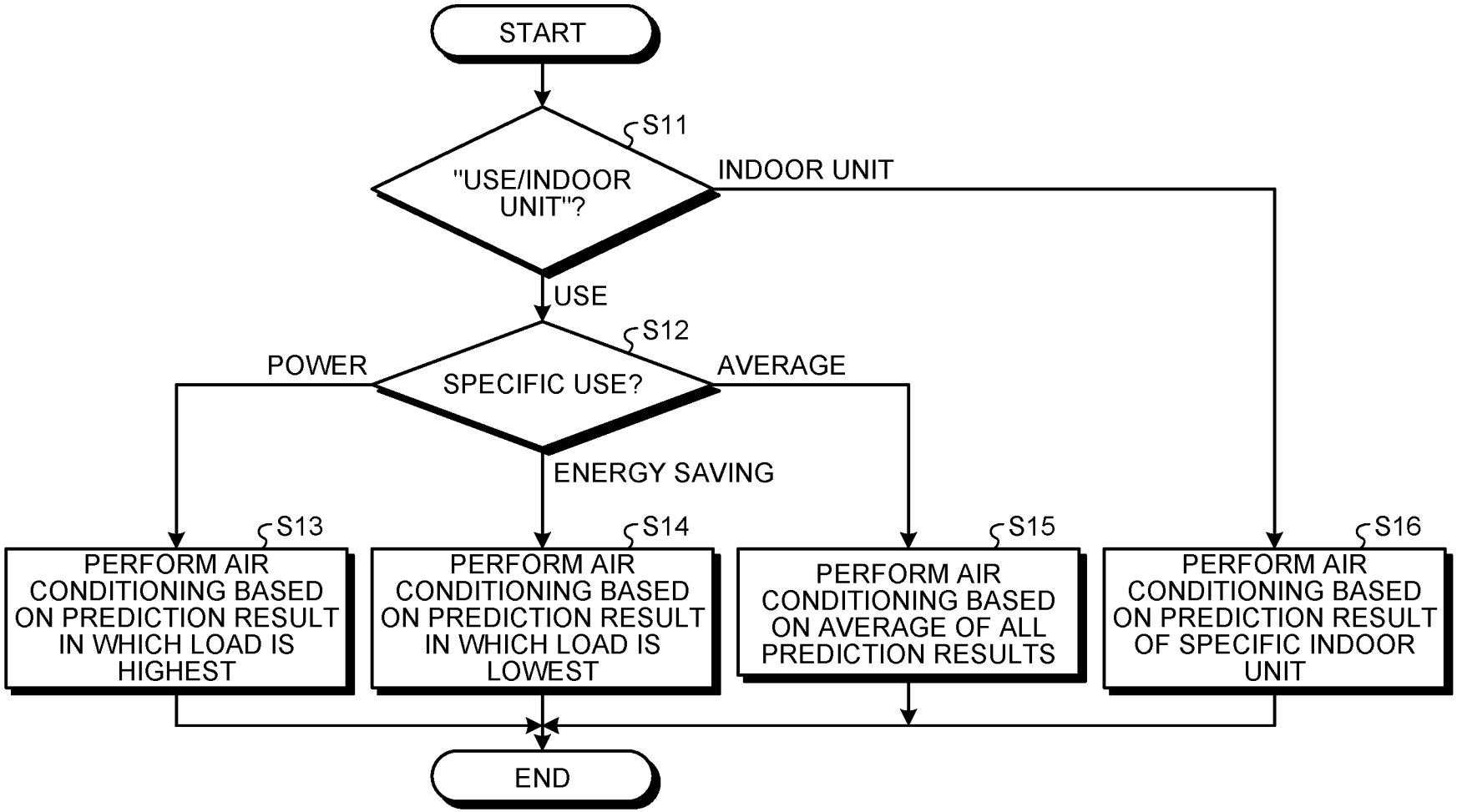
FIG. 8 is a second flowchart illustrating procedures of part of operations performed by the air conditioner according to the embodiment.

The receiving unit 312 receives an instruction set on the operating device 7 and transmitted from the operating device 7, and transmits the instruction to the outdoor unit controlling unit 21. The operation information obtaining unit 213 obtains the instruction transmitted from the receiving unit 312. This instruction is an instruction on the use of all the prediction results. FIG. 8 is a second flowchart illustrating procedures of part of operations performed by the air conditioner 1 according to the embodiment. FIG. 8 illustrates details of examples of the operations in steps S3 and S4 in FIG. 4.

The determining unit 214 determines whether the instruction on the use of all the prediction results is an instruction to specify a specific use of all the prediction results other than that of a particular indoor unit or an instruction to specify an indoor unit that has obtained a prediction result to be used (S11). In FIG. 8, the operation in step S11 is expressed by a text "'USE/INDOOR UNIT'?". If the instruction is determined to be an instruction to specify a specific use of all the prediction results other than that of a particular indoor unit (USE in S11), the determining unit 214 determines a specific use of all the prediction results (S12).

If the specific use is determined to be a use causing the air conditioner 1 to perform air conditioning at maximum power by the determining unit 214 (POWER in S12), the deciding unit 215 determines how air conditioning is to be performed on the basis of a prediction result in which the load of the air conditioner 1 is highest among all the prediction results, and the outdoor unit 2, the first indoor unit 3, the second indoor unit 4, the third indoor unit 5, and the fourth indoor unit 6 perform air conditioning on the basis of the prediction result in which the load is highest (S13). In the example of the room A in FIG. 2, the temperature of the space A3 is the highest of the four spaces, and because the load is higher as the temperature is higher in cooling operation, the outdoor unit 2, the first indoor unit 3, the second indoor unit 4, the third indoor unit 5, and the fourth indoor unit 6 perform air conditioning on the basis of the prediction result for the space A3.

If the specific use is determined to be a use causing the air conditioner 1 to perform air conditioning at minimum energy consumption by the determining unit 214 (ENERGY SAVING in S12), the deciding unit 215 determines how air conditioning is to be performed on the basis of a prediction result in which the load of the air conditioner 1 is lowest among all the prediction results, and the outdoor unit 2, the first indoor unit 3, the second indoor unit 4, the third indoor unit 5, and the fourth indoor unit 6 perform air conditioning on the basis of the prediction result in which the load is lowest (S14). In the example of the room A in FIG. 2, the temperature of the space A2 is the lowest of the four spaces, and because the load is lower as the temperature is lower in cooling operation, the outdoor unit 2, the first indoor unit 3, the second indoor unit 4, the third indoor unit 5, and the fourth indoor unit 6 perform air conditioning on the basis of the prediction result for the space A2.

Figure 9:
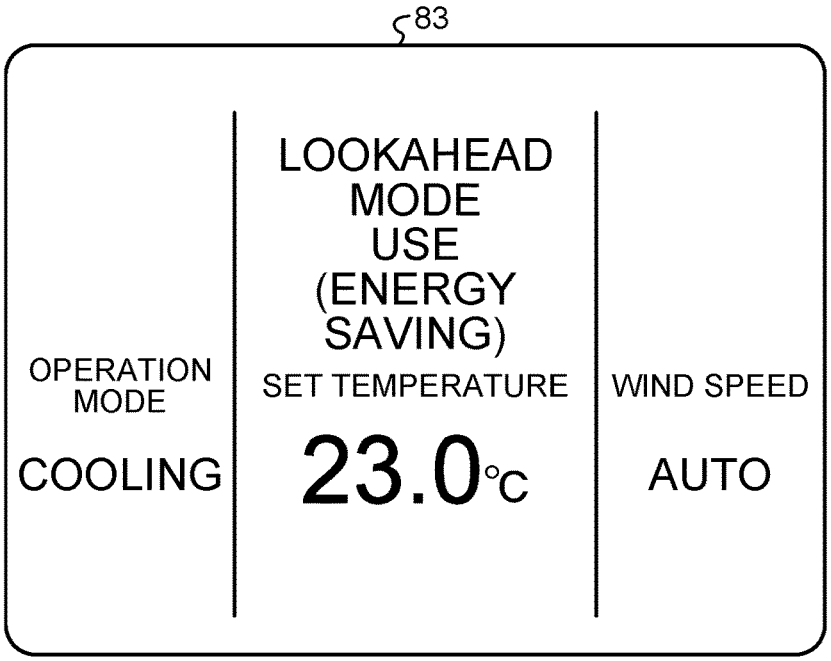
FIG. 9 is a diagram illustrating an example of a fourth image displayed by the operating device of the air conditioner according to the embodiment.

FIG. 9 is a diagram illustrating an example of a fourth image 83 displayed by the operating device 7 of the air conditioner 1 according to the embodiment. The fourth image 83 is displayed by the operating device 7 when air conditioning is to be performed on the basis of a prediction result in which the load of the air conditioner 1 is lowest among all the prediction results. Thus, the fourth image 83 is displayed when the button 77 is pressed on the second image 74. The fourth image 83 includes a text "LOOKAHEAD, USE, (ENERGY SAVING)" indicating that the air conditioner 1 performs air conditioning at lowest energy consumption, a text "OPERATION MODE, COOLING" indicating that cooling operation is performed, a text "SET TEMPERATURE 23.0° C." indicating that the set temperature is 23.0° C., and a text "WIND SPEED, AUTO" indicating that the wind speed is determined automatically.

If the specific use is determined to be a use causing the air conditioner 1 to perform air conditioning using an average of all the prediction results by the determining unit 214 (AVERAGE in S12), the deciding unit 215 determines how air conditioning is to be performed on the basis of an average of all the prediction results, and the outdoor unit 2, the first indoor unit 3, the second indoor unit 4, the third indoor unit 5, and the fourth indoor unit 6 perform air conditioning on the basis of the average of all the prediction results (S15).

If the instruction is determined to be an instruction to specify an indoor unit that has obtained a prediction result to be used by the determining unit 214 in step S11 (INDOOR UNIT in S11), the deciding unit 215 determines how air conditioning is to be performed on the basis of the prediction result obtained by the specified indoor unit, and the outdoor unit 2, the first indoor unit 3, the second indoor unit 4, the third indoor unit 5, and the fourth indoor unit 6 perform air conditioning on the basis of the prediction result obtained by the specified indoor unit (S16). For example, when the specified indoor unit is the first indoor unit 3, the outdoor unit 2, the first indoor unit 3, the second indoor unit 4, the third indoor unit 5, and the fourth indoor unit 6 perform air conditioning on the basis of the prediction result obtained by the first indoor unit 3.

Figure 10:
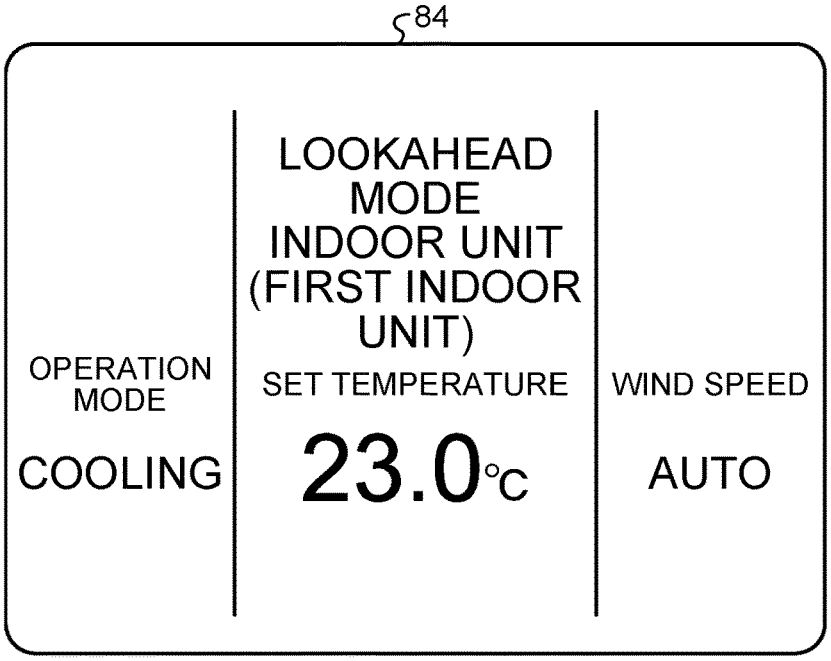
FIG. 10 is a diagram illustrating an example of a fifth image displayed by the operating device of the air conditioner according to the embodiment.

FIG. 10 is a diagram illustrating an example of a fifth image 84 displayed by the operating device 7 of the air conditioner 1 according to the embodiment. The fifth image 84 is displayed by the operating device 7 when air conditioning is to be performed on the basis of a prediction result obtained by a specified indoor unit. FIG. 10 illustrates the fifth image 84 in a case where the specified indoor unit is the first indoor unit 3. Specifically, the fifth image 84 includes a text "LOOKAHEAD MODE, INDOOR UNIT, (FIRST INDOOR UNIT)" indicating that the air conditioner 1 performs air conditioning on the basis of the prediction result obtained by the first indoor unit 3, a text "OPERATION MODE, COOLING" indicating that cooling operation is performed, a text "SET TEMPERATURE 23.0° C." indicating that the set temperature is 23.0° C., and a text "WIND SPEED, AUTO" indicating that the wind speed is determined automatically.

As described above, when all the prediction results are determined not to be the same, the air conditioner 1 according to the embodiment determines how air conditioning is to be performed on the basis of part or the whole of all the prediction results in accordance with an instruction received by the operating device 7. Thus, the air conditioner 1 can perform air conditioning of the room A on the basis of predicted temperatures of four spaces constituting the room A even when the predicted temperatures are not the same.

When all the prediction results are determined not to be the same, the air conditioner 1 receives an instruction on the use of all the prediction results from a user, and performs air conditioning in accordance with the instruction from the user. Thus, the air conditioner 1 can allow the user to determine use of all the prediction results when all the prediction results are determined not to be the same. For example, the user can cause the air conditioner 1 to perform air conditioning associated with the user's comfort or air conditioning associated with energy saving.

Note that, when all the prediction results are determined not to be the same, the operating device 7 may receive an instruction to achieve predetermined comfort. This instruction is one instruction on the use of all the prediction results. For example, when the operating device 7 has received an instruction to achieve predetermined comfort, the deciding unit 215 determines how air conditioning is to be performed on the basis of a prediction result in which the load of air conditioning is highest among all the prediction results. For example, the instruction to achieve predetermined comfort is an instruction to cause the air conditioner 1 to perform air conditioning at highest power.

The manner determined by the deciding unit 215 may vary depending on the number of indoor units connected with the outdoor unit 2. The manner determined by the deciding unit 215 may also vary depending on a result of determination on whether or not all the prediction results are the same. The operating device 7 periodically obtains information indicating the number of indoor units connected with the outdoor unit 2 and all the prediction results in order to appropriately display the first image 71, the second image 74, and the third image 78 allowing the user to set an instruction on the use of all the prediction results. The operating device 7 displays the first image 71, the second image 74, and the third image 78 on the basis of the periodically obtained information.

The air conditioner 1 according to the embodiment includes the first indoor unit 3, the second indoor unit 4, the third indoor unit 5, and the fourth indoor unit 6. As described above, the first indoor unit 3, the second indoor unit 4, the third indoor unit 5, and the fourth indoor unit 6 are an example of a plurality of indoor units. The air conditioner 1 may include two, three, five or more indoor units. Any one of a plurality of indoor units may perform operation different from that of another one of the indoor units.

In the embodiment described above, the indoor unit controlling unit 31 receives operation information transmitted from the operating device 7 and transmits the operation information to the outdoor unit controlling unit 21, and the outdoor unit controlling unit 21 receives the operation information transmitted from the indoor unit controlling unit 31 and transmits the operation information to the indoor unit controlling unit 41, the indoor unit controlling unit 51, and the indoor unit controlling unit 61. Alternatively, the indoor unit controlling unit 31 may transmit the operation information to the indoor unit controlling unit 41, the indoor unit controlling unit 51, and the indoor unit controlling unit 61.

The operating device 7 may be connected with any of the second indoor unit 4, the third indoor unit 5, and the fourth indoor unit 6 instead of the first indoor unit 3. In this case, the indoor unit connected with the operating device 7 among the second indoor unit 4, the third indoor unit 5, and the fourth indoor unit 6 includes a receiving unit having functions equivalent to those of the receiving unit 312, and a display controlling unit having functions equivalent to those of the display controlling unit 313. The operating device 7 may be connected with any indoor unit, and in any case, the operation information is transmitted in the same manner as the case where the operating device 7 is connected with the first indoor unit 3.

The outdoor unit controlling unit 21 may include a predicting unit having the functions of the predicting unit 311, the predicting unit 411, the predicting unit 511, and the predicting unit 611.

The component information obtaining unit 211, the prediction result obtaining unit 212, the operation information obtaining unit 213, the determining unit 214, and the deciding unit 215 may each be provided in any of the first indoor unit 3, the second indoor unit 4, the third indoor unit 5, and the fourth indoor unit 6.

Figure 11:
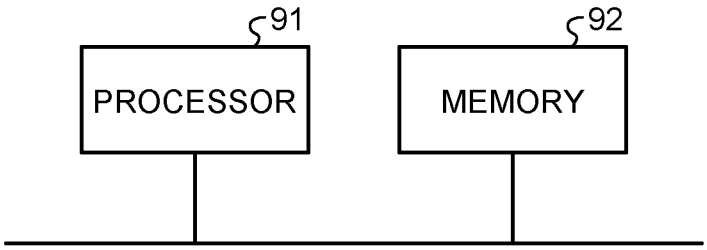
FIG. 11 is a diagram illustrating a processor in a case where at least part of an outdoor unit controlling unit included in an outdoor unit of the air conditioner according to the embodiment is implemented by the processor.

FIG. 11 is a diagram illustrating a processor 91 in a case where at least part of the outdoor unit controlling unit 21 included in the outdoor unit 2 of the air conditioner 1 according to the embodiment is implemented by the processor 91. In other words, at least some of the functions of the outdoor unit controlling unit 21 may be implemented by the processor 91 executing programs stored in a memory 92.

The processor 91 is a central processing unit (CPU), a processing device, a computing device, a microprocessor, or a digital signal processor (DSP). FIG. 11 also illustrates the memory 92.

In a case where at least some of the functions of the outdoor unit controlling unit 21 are implemented by the processor 91, the at least some of the functions are implemented by the processor 91 and software, firmware, or combination of software and firmware. The software or firmware is described in the form of programs and stored in the memory 92. The processor 91 implements at least some of the functions of the outdoor unit controlling unit 21 by reading and executing the programs stored in the memory 92.

In the case where at least some of the functions of the outdoor unit controlling unit 21 are implemented by the processor 91, the outdoor unit 2 includes the memory 92 for storing programs that result in execution of at least some of the steps performed by the outdoor unit controlling unit 21.

In other words, the programs stored in the memory 92 cause a computer to execute at least part of the outdoor unit controlling unit 21.

The memory 92 is a nonvolatile or volatile semiconductor memory such as a random access memory (RAM), a read only memory (ROM), a flash memory, or an erasable programmable read only memory (EPROM), an electrically erasable programmable read-only memory (EEPROM) (registered trademark); a magnetic disk; a flexible disk; an optical disk; a compact disc; a mini disc; a digital versatile disk (DVD); or the like, for example.

Figure 12:
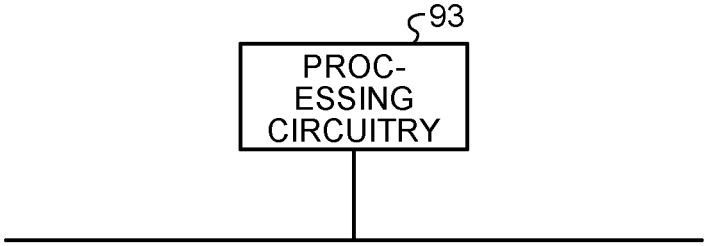
FIG. 12 is a diagram illustrating processing circuitry in a case where at least part of the outdoor unit controlling unit included in the outdoor unit of the air conditioner according to the embodiment is implemented by the processing circuitry.

FIG. 12 is a diagram illustrating processing circuitry 93 in a case where at least part of the outdoor unit controlling unit 21 included in the outdoor unit 2 of the air conditioner 1 according to the embodiment is implemented by the processing circuitry 93. In other words, at least part of the outdoor unit controlling unit 21 may be implemented by the processing circuitry 93.

The processing circuitry 93 is dedicated hardware. The processing circuitry 93 is a single circuit, a composite circuit, a programmed processor, a parallel-programmed processor, an application specific integrated circuit (ASIC), a field programmable gate array (FPGA), or a combination thereof, for example.

Part of the outdoor unit controlling unit 21 may be dedicated hardware separate from the remaining part thereof.

Some of a plurality of functions of the outdoor unit controlling unit 21 may be implemented by software or firmware, and the other functions thereof may be implemented by dedicated hardware. As described above, the functions of the outdoor unit controlling unit 21 can be implemented by hardware, software, firmware, or a combination thereof.

At least part of the indoor unit controlling unit 31 and the detecting unit 32 of the first indoor unit 3 may be implemented by a processor or may be implemented by processing circuitry. At least part of the indoor unit controlling unit 41 and the detecting unit 42 of the second indoor unit 4 may be implemented by a processor or may be implemented by processing circuitry. At least part of the indoor unit controlling unit 51 and the detecting unit 52 of the third indoor unit 5 may be implemented by a processor or may be implemented by processing circuitry. At least part of the indoor unit controlling unit 61 and the detecting unit 62 of the fourth indoor unit 6 may be implemented by a processor or may be implemented by processing circuitry. The processor is a processor similar to the processor 91. The processing circuitry is processing circuitry similar to the processing circuitry 93.

The configurations presented in the embodiment above are examples, and can be combined with other known technologies or can be partly omitted or modified without departing from the gist thereof.

REFERENCE SIGNS LIST

1 air conditioner; 2 outdoor unit; 3 first indoor unit; 4 second indoor unit; 5 third indoor unit; 6 fourth indoor unit; 7 operating device; 8 refrigerant piping; 9 first communication line; 10 second communication line; 21 outdoor unit controlling unit; 22 outdoor unit heat exchanger; 23 outdoor unit fan; 24 compressor; 25 four-way valve; 26 expansion valve; 31, 41, 51, 61 indoor unit controlling unit; 32, 42, 52, 62 detecting unit; 33, 43, 53, 63 indoor unit heat exchanger; 34, 44, 54, 64 indoor unit fan; 71 first image; 72, 73, 75, 76, 77, 79, 80, 81, 82 button; 74 second image; 78 third image; 83 fourth image; 84 fifth image; 91 processor; 92 memory; 93 processing circuitry; 211 component information obtaining unit; 212 prediction result obtaining unit; 213 operation information obtaining unit; 214 determining unit; 215 deciding unit; 311, 411, 511, 611 predicting unit; 312 receiving unit; 313 display controlling unit; A room; A1, A2, A3, A4 space; B window; C heat source.

The invention claimed is:

1. An air conditioner comprising:

an outdoor unit;

a plurality of indoor units connected with the outdoor unit, to perform air conditioning with the outdoor unit;

a plurality of temperature sensors to detect a state relating to temperature;

a remote controller that controls the outdoor unit and the plurality of indoor units, the remote controller is operable by a user, and receives an instruction on use of a prediction result obtained for each space of a plurality of spaces constituting a room;

at least one processor and/or circuit configured to determine, as a determination result, whether or not all the prediction results are same; and determine a manner how air conditioning is to be performed on the basis of the determination result obtained by determining whether or not all the prediction results are same, wherein each indoor unit of the plurality of the indoor units is associated with respectively one space of the plurality of spaces, each temperature sensor of the plurality of temperature sensors is associated with respectively one associated space of the plurality of spaces and detects a state relating to temperature of the associated space, each space of the plurality of spaces is associated with respectively one of the indoor units and with respectively one of the temperature sensors, the prediction result obtained for each space of the plurality of spaces is a predicted temperature of the each space associated with respectively one of the temperature sensors a predetermined time after the one of the temperature sensors has obtained a detection result, the temperature being predicted on the basis of the detection result, all the prediction results are prediction results obtained for all of the plurality of spaces, each of the prediction results being obtained for respectively one of the spaces, the at least one processor and/or circuit is further configured to in response to all the prediction results being determined to be same, determine the manner how air conditioning is to be performed on the basis of any one of all the prediction results, in response to all the prediction results being determined not to be same, determine the manner how air conditioning is to be performed on the basis of part or the whole of all the prediction results in accordance with the instruction received by the remote controller, and the outdoor unit and the indoor units perform air conditioning of the room on the basis of the manner determined by the at least one processor and/or circuit.

2. The air conditioner according to claim 1 wherein all the prediction results obtained by the indoor units are transmitted to the outdoor unit and the remote controller.

3. The air conditioner according to claim 1 wherein the remote controller receives the instruction to specify a prediction result to be used for air conditioning after all the prediction results are determined not to be same by the at least one processor and/or circuit.

4. The air conditioner according to claim 1 wherein the instruction received by the remote controller is an instruction to achieve predetermined comfort or an instruction to minimize energy consumption.

5. The air conditioner according to claim 1 wherein the instruction received by the remote controller is any of an instruction to achieve predetermined comfort, an instruction to minimize energy consumption, and an instruction to use an average of all the prediction results, the at least one processor and/or circuit is further configured to in response to all the prediction results being determined not to be same by the at least one processor and/or circuit, in response to the operating device remote controller having received the instruction to achieve the predetermined comfort, determine the manner how air conditioning is to be performed on the basis of a prediction result in which a load of air conditioning is highest among all the prediction results, in response to the remote controller having received the instruction to minimize the energy consumption, determine the manner how air conditioning is to be performed on the basis of a prediction result in which a load of air conditioning is lowest among all the prediction results, and in response to the remote controller having received the instruction to use an average of all the prediction results, determine the manner how air conditioning is to be performed on the basis of the average of all the prediction results.

6. The air conditioner according to claim 1 wherein in response to all the prediction results being determined not to be same, the remote controller receives the instruction to specify an indoor unit obtaining a prediction result to be used in air conditioning among the indoor units.

* * * * *